US011028763B2

(12) United States Patent
Takagi et al.

(10) Patent No.: US 11,028,763 B2
(45) Date of Patent: Jun. 8, 2021

(54) ENGINE COOLING DEVICE

(71) Applicant: TOYOTA JIDOSHA KABUSHIKI KAISHA, Toyota (JP)

(72) Inventors: Noboru Takagi, Toyota (JP); Kazuki Kato, Toyoake (JP); Masaaki Yamaguchi, Okazaki (JP); Toshio Takaoka, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/996,973

(22) Filed: Aug. 19, 2020

(65) Prior Publication Data

US 2021/0087964 A1 Mar. 25, 2021

(30) Foreign Application Priority Data

Sep. 19, 2019 (JP) ..... JP2019-170211

(51) Int. Cl.

| | |
|---|---|
| ***F01P 3/20*** | (2006.01) |
| ***F01P 7/14*** | (2006.01) |
| ***F01P 5/12*** | (2006.01) |
| ***F02F 1/16*** | (2006.01) |

(52) U.S. Cl.

CPC ..... *F01P 5/12* (2013.01); *F01P 7/14* (2013.01); *F02F 1/16* (2013.01); *F01P 2007/146* (2013.01); *F01P 2025/08* (2013.01); *F01P 2025/64* (2013.01)

(58) Field of Classification Search

CPC ..... F01P 2007/146; F01P 3/20; F01P 7/14; F01P 5/10; F01P 2025/66

See application file for complete search history.

(56) References Cited

U.S. PATENT DOCUMENTS

| | | | | |
|---|---|---|---|---|
| 2011/0162595 | A1* | 7/2011 | Traudt | F01P 7/14 123/41.1 |
| 2016/0376977 | A1 | 12/2016 | Watanabe | |
| 2017/0298805 | A1* | 10/2017 | Kloft | F01P 3/02 |
| 2017/0370274 | A1* | 12/2017 | Hoffmann | F01P 3/20 |
| 2018/0038268 | A1* | 2/2018 | Kloft | F01P 11/04 |
| 2018/0320692 | A1* | 11/2018 | Zielberg | F04D 5/002 |

FOREIGN PATENT DOCUMENTS

| | | | |
|---|---|---|---|
| JP | 2013-234605 | A | 11/2013 |
| JP | 6225949 | B2 | 11/2017 |

* cited by examiner

*Primary Examiner* — Long T Tran

(74) *Attorney, Agent, or Firm* — Oblon, McClelland, Maier & Neustadt, L.L.P.

(57) ABSTRACT

An engine cooling device has a mechanical water pump, a flow rate control valve having a valve body of which a relative rotational position is changed by a motor, and a control unit that performs drive control of the motor to change the relative rotational position of the valve body to a target relative rotational position. The control unit performs protection control for setting the relative rotational position where a withstanding pressure limit rotational speed is equal to or higher than a current engine rotational speed, as a target operating position of the valve body of the flow rate control valve when the engine rotational speed rises, and performs retreat control for reducing a set range of the target relative rotational position to a prescribed retreat operation range when the supply voltage of the in-vehicle electric power supply has dropped.

8 Claims, 6 Drawing Sheets

ENGINE COOLING DEVICE

CROSS-REFERENCE TO RELATED APPLICATION

This application claims priority to Japanese Patent Application No. 2019-170211 filed on Sep. 19, 2019, incorporated herein by reference in its entirety.

BACKGROUND

1. Technical Field

The present disclosure relates to an engine cooling device that is equipped with a mechanical water pump and a flow rate control valve.

2. Description of Related Art

A device described in Japanese Patent Application Publication No. 2013-234605 (JP 2013-234605 A) is conventionally known as a water-cooling engine cooling device that cools an engine by circulating coolant through a water jacket formed inside the engine. The engine cooling device described in Japanese Patent Application Publication No. 2013-234605 (JP 2013-234605 A) is equipped with a mechanical water pump that delivers coolant to a water jacket in response to rotation of an engine, and an electronic control valve that closes to limit the outflow of coolant from the water jacket. Moreover, when the engine has not been warmed up, the warm-up of the engine is accelerated by leaving coolant in the water jacket by closing the electronic control valve.

Incidentally, the discharge pressure of the mechanical water pump rises as the engine rotational speed rises. Therefore, when the engine rotational speed becomes high with the electronic control valve closed, the hydraulic pressure of the water jacket may become too high. As a measure against this problem, the foregoing conventional engine cooling device restrains the hydraulic pressure of the water jacket from rising, by forcibly opening the electronic control valve without waiting for the completion of warm-up, in the case where the engine rotational speed becomes equal to or higher than a certain rotational speed when the electronic control valve is closed to accelerate warm-up.

SUMMARY

However, when the supply voltage of an in-vehicle electric power supply drops, the time needed to open the electronic control valve becomes long, and the hydraulic pressure remains high during the time. Therefore, it may be impossible to sufficiently restrain the hydraulic pressure from rising.

An engine cooling device that solves the foregoing problem is equipped with a circulation circuit for coolant flowing through a water jacket formed inside an engine, a mechanical water pump that operates in response to rotation of the engine and that circulates the coolant through the circulation circuit, a flow rate control valve that serves to adjust a flow rate of the coolant flowing through the circulation circuit, that has a valve body driven by an electric actuator operating by being supplied with electric power from an in-vehicle electric power supply, and that allows a flow channel area for the coolant to change depending on an operating position of the valve body, and a control unit that sets an operating position within a prescribed control range as a target operating position in accordance with an operating situation of the engine, and that performs drive control of the actuator to change the operating position of the valve body to the set target operating position. The control unit in the foregoing engine cooling device performs protection control for setting an operating position where a withstanding pressure limit rotational speed is equal to or higher than a current engine rotational speed, as the target operating position. Furthermore, the control unit performs retreat control for reducing the control range to a retreat operation range set in advance, as a range of the operating position including a maximum withstanding pressure operating position, when a supply voltage of the in-vehicle electric power supply has dropped. Incidentally, the withstanding pressure limit rotational speed mentioned herein means a maximum value of the engine rotational speed at which a hydraulic pressure in any region of the circulation circuit is lower than an upper limit of the hydraulic pressure permissible in the region. Besides, the maximum withstanding pressure operating position means an operating position where the withstanding pressure limit rotational speed is highest among operating positions within the control range.

In the engine cooling device configured as described above, the mechanical water pump that operates in response to rotation of the engine circulates the coolant through the circulation circuit. Therefore, when the engine rotational speed rises, the hydraulic pressure of the circulation circuit rises. Then, when the hydraulic pressure in any region of the circulation circuit has remained higher than a withstanding pressure limit in the region, namely, an upper limit of the hydraulic pressure permissible in the region as a result, the component members of the circulation circuit cannot withstand the hydraulic pressure, thus causing leakage of the coolant and the like.

On the other hand, when the operating position of the valve body of the flow rate control valve is changed to change the flow of the coolant through the circulation circuit, the hydraulic pressure in each region of the circulation circuit changes. In consequence, when the operating position of the flow rate control valve is changed to prevent the hydraulic pressure from becoming higher than the withstanding pressure limit in any region of the circulation circuit even in the case where the engine rotational speed rises, the component members of the circulation circuit can be protected against the hydraulic pressure. Incidentally, the maximum value of the engine rotational speed at which the hydraulic pressure in any region of the circulation circuit is lower than the upper limit of the hydraulic pressure permissible in the region, namely, the withstanding pressure limit rotational speed differs depending on the operating position of the valve body. In consequence, the protection of the component members of the circulation circuit against the hydraulic pressure can be achieved by driving the valve body to the operating position where the withstanding pressure limit rotational speed is equal to or higher than the current engine rotational speed. Therefore, the control unit of the foregoing engine cooling device protects the component members of the circulation circuit against the hydraulic pressure, by performing protection control for setting the operating position where the withstanding pressure limit rotational speed is equal to or higher than the current engine rotational speed, as the target operating position, when the engine rotational speed rises.

By the way, in the foregoing engine cooling device, the operating position of the valve body is changed by the electric actuator that operates by being supplied with electric power from the in-vehicle electric power supply. Therefore, when the supply voltage of the in-vehicle electric power supply drops, the speed at which the operating position of the valve body is changed by the actuator drops. Accordingly, when the supply voltage has dropped, the time needed to change the operating position of the valve body in protection control becomes long, and it may become impossible to sufficiently restrain the hydraulic pressure of the circulation circuit from rising.

As a measure against this problem, with the foregoing engine cooling device, when the supply voltage of the in-vehicle electric power supply has dropped, retreat control for reducing the control range to the retreat operation range set in advance as the range of the operating position including the maximum withstanding pressure operating position is performed. Then, the operating position of the valve body is thus changed to the operating position within the retreat operation range, namely, into the range that is not very distant from the maximum withstanding pressure operating position. Therefore, even when the amount of change in the operating position of the valve body in the case where protection control is thereafter performed in response to a rise in engine rotational speed has stopped increasing after reaching a certain amount and the speed of change in the operating position of the valve body has dropped in response to a drop in the supply voltage of the in-vehicle electric power supply, the time needed to change the operating position of the valve body in protection control is unlikely to become long. Accordingly, with the foregoing engine cooling device, the time needed to restrain the hydraulic pressure of the circulation circuit from rising when the engine rotational speed rises is unlikely to become long, even when the supply voltage of the in-vehicle electric power supply has dropped.

Incidentally, in protection control as described above as well, the hydraulic pressure is insufficiently restrained from rising, unless an appropriate operating position where the withstanding pressure limit rotational speed is equal to or higher than the current engine rotational speed is set as the target rotational position. As a measure against this problem, the foregoing engine cooling device may be provided with a storage unit in which information on the withstanding pressure limit rotational speed at each operating position of the valve body is stored, and the control unit may perform protection control by obtaining an operating position of the valve body where the withstanding pressure limit rotational speed is higher than the current engine rotational speed, based on the information stored in the storage unit, and by setting the obtained operating position as the target operating position. In such a case, the information on the withstanding pressure limit rotational speed at each operating position of the valve body is stored in advance in the storage unit. Therefore, the operating position where the withstanding pressure limit rotational speed is equal to or higher than the current engine rotational speed can be adequately set as the target rotational position, based on the information.

In the case where the hydraulic pressure of the circulation circuit cannot be sufficiently restrained from rising even when protection control as described above is performed, it is conceivable to achieve protection of the component members of the circulation circuit by reducing the engine torque to lower the engine rotational speed. A determination on such an additional reduction in engine torque can be made by causing the control unit of the foregoing engine cooling device to make a determination on the necessity to reduce the engine torque by determining that the engine torque needs to be reduced when the current engine rotational speed has remained higher than a withstanding pressure limit rotational speed at the current operating position of the valve body for a prescribed time or more.

Immediately after the startup of the engine, the supply voltage of the in-vehicle electric power supply may temporarily drop due to the consumption of electric power for the startup of the engine. This drop in the supply voltage of the in-vehicle electric power supply immediately after the startup of the engine is stopped in a short time. Therefore, the performance of retreat control is often unnecessary as a measure against the drop in supply voltage at this time. Under these circumstances, the control unit of the foregoing engine cooling device may determine that a supply voltage of the in-vehicle electric power supply has dropped when the supply voltage is equal to or lower than a voltage drop determination value, and set a higher voltage as the voltage drop determination value when an elapsed time after the startup of the engine is shorter than a prescribed time than when the elapsed time is equal to or longer than the prescribed time.

When the temperature of coolant is low, the viscosity of coolant is high, and the flow resistance of coolant applied to the valve body in changing the operating position is high. Therefore, even when the temperature of coolant is low, the speed at which the operating position of the valve body is changed by the actuator is low. Therefore, the control unit of the foregoing engine cooling device is also desired to perform retreat control when a temperature of the coolant is equal to or lower than a prescribed low coolant temperature determination value.

Incidentally, in the case where protection control may be performed in a short time even when the supply voltage of the in-vehicle electric power supply has not dropped, it is desirable to make the completion of the change in the operating position of the valve body in protection control possible in a short time by performing retreat control. In one of such cases, the engine rotational speed has risen to such an extent that protection control needs to be performed due to a subsequent slight rise in engine rotational speed. In consequence, the control unit of the foregoing engine cooling device may also perform the retreat control when the engine rotational speed is equal to or higher than a prescribed retreat start rotational speed. Furthermore, in the case where this engine cooling device is applied to an engine mounted on a vehicle, the control unit may set a lower rotational speed as the retreat start rotational speed when the transmission of motive power between the engine and wheels is shut off than when the transmission of motive power between the engine and the wheels is not shut off. When the transmission of motive power between the engine and the wheels is shut off, the rotational load of the engine is low, so the speed of rise in engine rotational speed tends to be higher than when the foregoing transmission of motive power is not shut off. Therefore, when the foregoing transmission of motive power is shut off, it is desirable to perform retreat control from the engine rotational speed that is lower than when the foregoing transmission of motive power is not shut off.

Besides, in the engine mounted on the vehicle, the engine rotational speed may rapidly rise due to a downshift or the like during coasting of the vehicle when the engine is dragged as the wheels rotate. In consequence, in the case where the foregoing engine cooling device is applied to an engine mounted on a vehicle, the control unit is also desired to perform retreat control while the vehicle is coasting.

BRIEF DESCRIPTION OF THE DRAWINGS

Features, advantages, and technical and industrial significance of exemplary embodiments of the present disclosure will be described below with reference to the accompanying drawings, in which like signs denote like elements, and wherein.

DETAILED DESCRIPTION OF EMBODIMENTS

Figure 1:
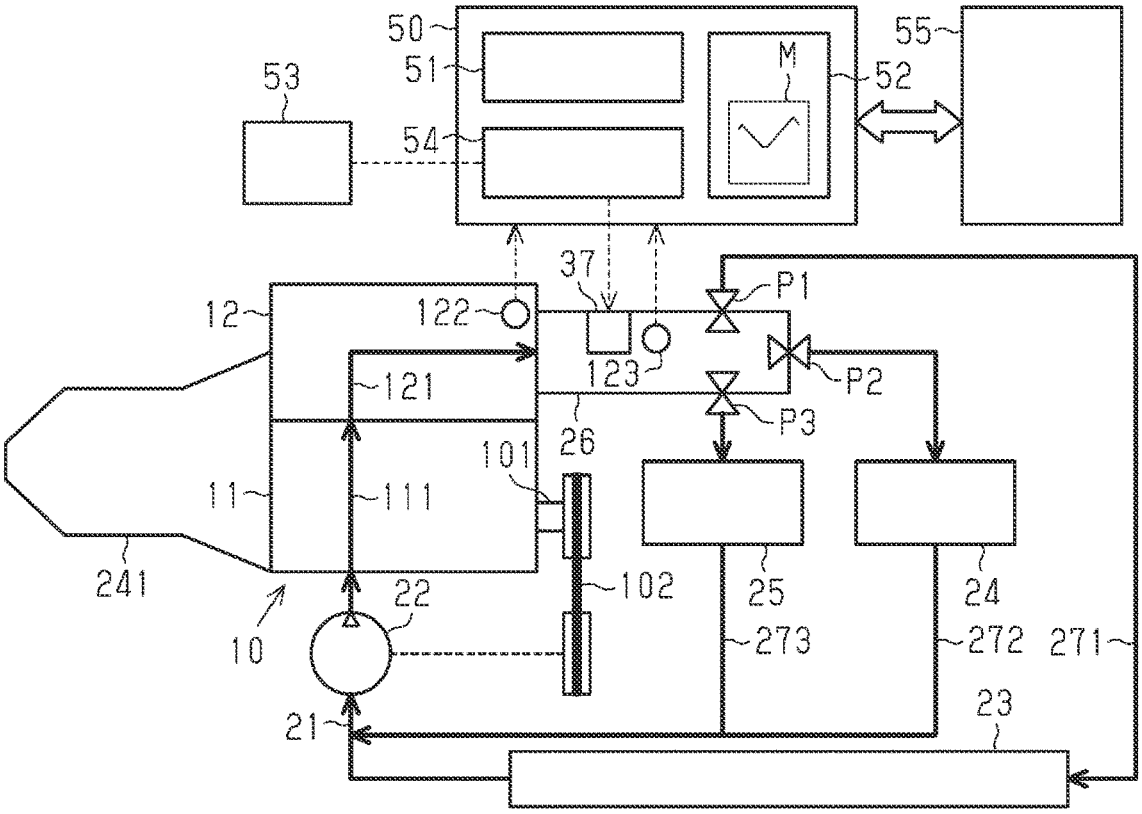
FIG. 1 is a view schematically showing the configuration of an engine cooling device according to one of the embodiments.

An engine cooling device according to one of the embodiments will be described hereinafter with reference to FIGS. 1 to 8. The engine cooling device according to the present embodiment is applied to an engine mounted on a vehicle having an automatic transmission. As shown in FIG. 1, the engine cooling device according to the present embodiment is equipped with a circulation circuit 21 through which coolant flowing through a water jacket 111 in a cylinder block 11 of an engine 10 and a water jacket 121 in a cylinder head 12 of the engine 10 circulates. The circulation circuit 21 is provided with a mechanical water pump 22 that discharges coolant toward the water jacket 111 in the cylinder block 11. Besides, the circulation circuit 21 is provided with three heat exchangers, namely, a radiator 23, an ATF warmer 24, and a heater core 25 of an air-conditioner for the vehicle. The radiator 23 cools coolant through the exchange of heat with outside air. The ATF warmer 24 heats up or cools automatic transmission fluid (ATF) as hydraulic oil of an automatic transmission 241 coupled to the engine 10, through the exchange of heat with coolant. The heater core 25 warms the air blown into a cabin by the air-conditioner, through the exchange of heat with coolant.

Incidentally, the water pump 22 is coupled to a crankshaft 101 of the engine 10 via a wrapping transmission mechanism 102. Thus, the water pump 22 operates in response to rotation of the crankshaft 101 of the engine 10, and delivers coolant toward the water jacket 111.

The circulation circuit 21 is provided with a flow rate control valve 26 into which the coolant that has flowed out from the water jacket 121 in the cylinder head 12 flows. The flow rate control valve 26 has three ports, namely, a radiator port P1, a device port P2, and a heater port P3 as output ports for causing the coolant that has flowed into the flow rate control valve 26 to flow out. The radiator port P1 is connected to a first coolant channel 271 through which coolant is caused to flow via the radiator 23. The device port P2 is connected to a second coolant channel 272 through which coolant is caused to flow via the ATF warmer 24. The heater port P3 is connected to a third coolant channel 273 through which coolant is caused to flow via the heater core 25. Incidentally, the circulation circuit 21 is provided with a coolant temperature sensor 122 that detects a temperature of coolant flowing into the flow rate control valve 26 after flowing out from the water jacket 121 in the cylinder head 12.

Furthermore, the engine cooling device according to the present embodiment is equipped with a control unit 50 as a control unit of the engine cooling device. The control unit 50 is equipped with an arithmetic processing circuit 51 that performs arithmetic processing for controlling the engine cooling device, and a memory 52 in which programs and data for control are stored. Besides, the control unit 50 is provided with a voltage adjusting circuit 54 that adjusts a voltage supplied from an in-vehicle electric power supply 53 through pulse width modulation and that supplies the adjusted voltage to a motor 37 built in the flow rate control valve 26. Incidentally, various pieces of information on an operating situation of the engine 10 and a running situation of the vehicle are input to the control unit 50. The pieces of information input to the control unit 50 include the temperature of coolant detected by the coolant temperature sensor 122, an engine rotational speed NE, the setting of a shift range of the automatic transmission 241, an operation amount of an acceleration pedal, a supply voltage of the in-vehicle electric power supply 53, and information on how the cabin is warmed by the air-conditioner. Incidentally, the control unit 50 is connected to an engine control unit 55 as an electronic control unit for engine control, through an in-vehicle communication line.

Figure 2:
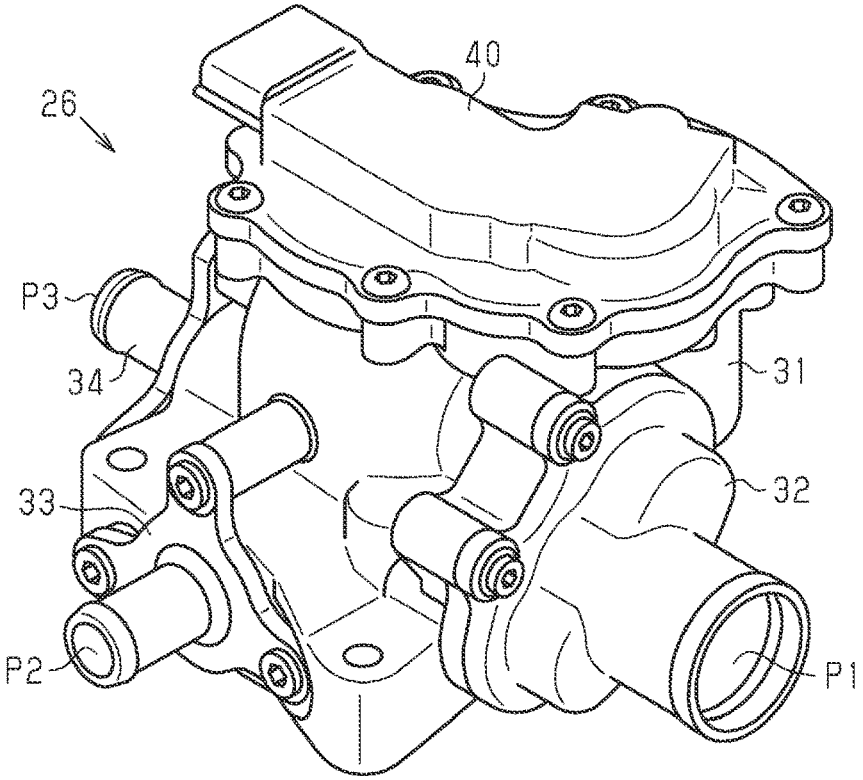
FIG. 2 is a perspective view of a flow rate control valve provided in the cooling device.

Subsequently, the configuration of the flow rate control valve 26 will be described with reference to FIGS. 2 to 6B. As shown in FIG. 2, the flow rate control valve 26 is equipped with a housing 31 that forms the skeleton of the flow rate control valve 26. A first connector member 32, a second connector member 33, and a third connector member 34 are attached to the housing 31. The first connector member 32 is provided with a radiator port P1. The second connector member 33 is provided with a device port P2. The third connector member 34 is provided with a heater port P3. Moreover, with the connector members 32 to 34 attached to the housing 31, the output ports P1 to P3 are arranged at different positions.

Figure 3:
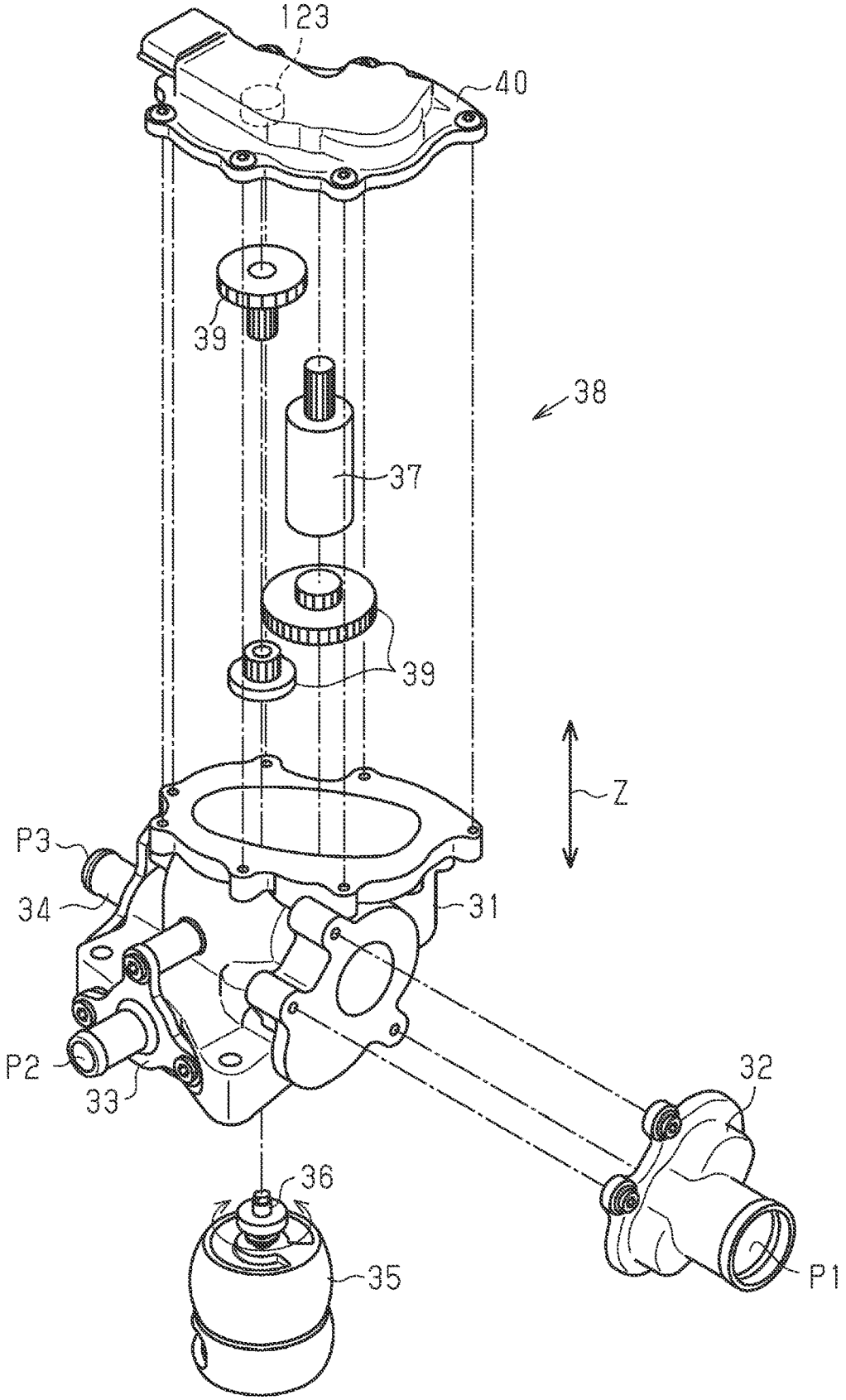
FIG. 3 is an exploded perspective view of the flow rate control valve.

As shown in FIG. 3, the flow rate control valve 26 is equipped with a valve body 35 that is accommodated in the housing 31. A coolant channel is formed in the valve body 35. Besides, a shaft 36 that extends in an axial direction Z of the housing 31 is coupled to the valve body 35. Moreover, the valve body 35 rotates around the shaft 36 as indicated by an arrow in FIG. 3. When a relative angle ANG of the valve body 35 relative to the housing 31 changes through rotation of the valve body 35, the degrees to which the coolant channel formed in the valve body 35 overlaps with the output ports P1 to P3 change, and the flow channel areas of coolant at the output ports P1 to P3 change. That is, the flow of coolant in the circulation circuit 21 can be controlled by changing the rotational phase of the valve body 35 relative to the housing 31.

The motor 37 is accommodated in the housing 31 of the flow rate control valve 26. Besides, a transmission mechanism 38 is provided in the housing 31. The transmission mechanism 38 has a plurality of gears 39 that mesh with one another, and transmits an output of the motor 37 to the shaft 36 of the valve body 35 via the gears 39.

A cover 40 is attached to the housing 31 in such a manner as to cover that part of the housing 31 which accommodates the motor 37 and the transmission mechanism 38. A rotational angle sensor 123 that detects a rotational angle of the motor 37 is installed in the cover 40. Incidentally, information on the rotational angle of the motor 37 detected by the rotational angle sensor 123 is also input to the control unit 50.

Figure 4:
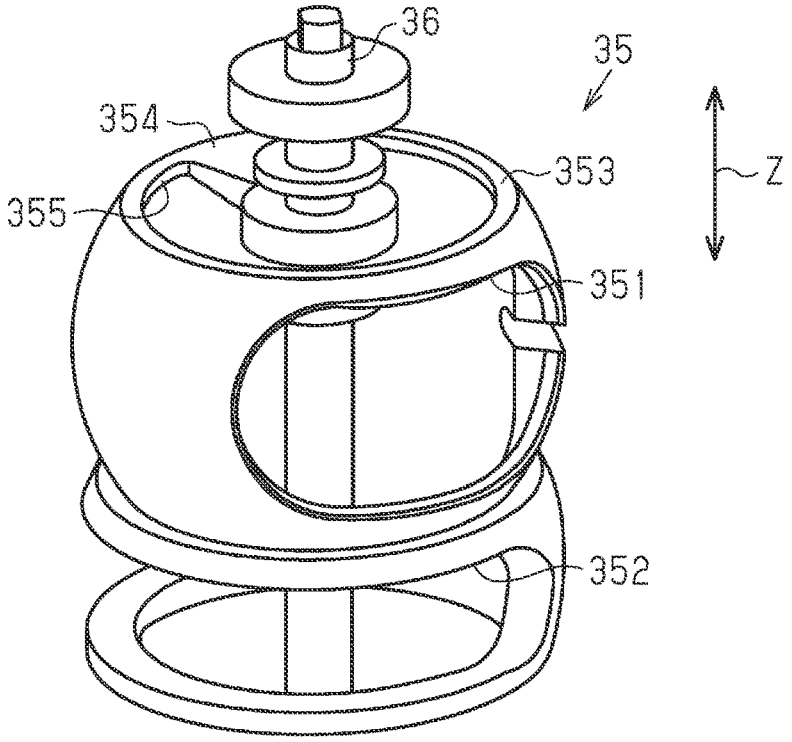
FIG. 4 is a perspective view of a valve body as a component member of the flow rate control valve.

As shown in FIG. 4, the valve body 35 assumes a shape that is obtained by, for example, superimposing two barrel-like objects on each other in the axial direction Z of the housing 31. Two holes 351 and 352 that are aligned in the axial direction Z, namely, the first hole 351 and the second hole 352 are formed through a lateral wall of the valve body 35. The holes 351 and 352 constitute part of the coolant channel provided in the valve body 35. The first hole 351 is located above in the drawing, and communicates with the radiator port P1 when the valve body 35 is within a certain angular range relative to the housing 31. When the first hole 351 communicates with the radiator port P1, the coolant that has flowed into the flow rate control valve 26 flows out from the radiator port P1. Besides, the second hole 352 communicates with at least one of the device port P2 and the heater port P3 when the valve body 35 is within another angular range relative to the housing 31. When the second hole 352 communicates with the device port P2, the coolant that has flowed into the flow rate control valve 26 flows out from the device port P2. Besides, when the second hole 352 communicates with the heater port P3, the coolant that has flowed into the flow rate control valve 26 flows out from the heater port P3.

In the case where an upper wall 353 of the valve body 35 is defined as an upper wall of the valve body 35 in the drawing, the shaft 36 is connected to the upper wall 353. Besides, the upper wall 353 is provided with a circular groove 355 that extends in such a manner as to surround a root of the shaft 36 in such a manner as to leave a part thereof as an engagement portion 354.

Figure 5:
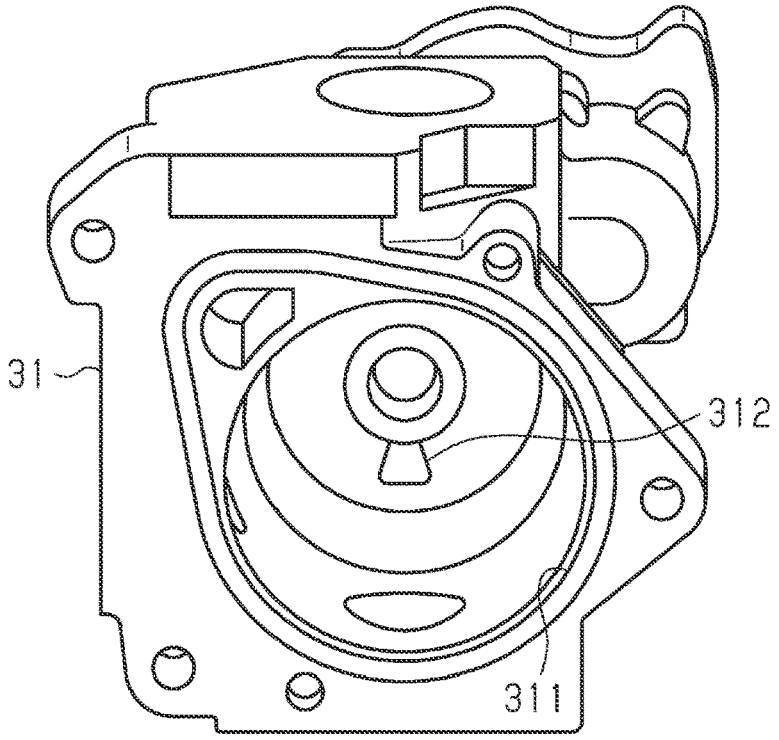
FIG. 5 is a perspective view of a housing as another component member of the flow rate control valve.

FIG. 5 shows the perspective structure of the housing 31 as viewed in a direction in which the valve body 35 is inserted. In assembling the flow rate control valve 26, the valve body 35 is inserted into the housing 31 via an accommodation opening 311. That part of the housing 31 which faces the upper wall 353 of the valve body 35 is provided with a stopper 312 accommodated in the groove 355. Therefore, when the valve body 35 is accommodated in the housing 31, the engagement portion 354 of the valve body 35 abuts on the stopper 312 to thereby keep the valve body 35 from rotating relatively to the housing 31. That is, the range where the engagement portion 354 does not abut on the stopper 312 is a range where the valve body 35 is allowed to rotate relatively to the housing 31.

Coolant flows into the housing 31 of the flow rate control valve 26, via the accommodation opening 311. That is, the accommodation opening 311 functions as an input port of the flow rate control valve 26. Then, the coolant that has flowed into the housing 31 flows through the coolant channel provided in the valve body 35, and is introduced to the output ports P1 to P3.

Figure 6A:
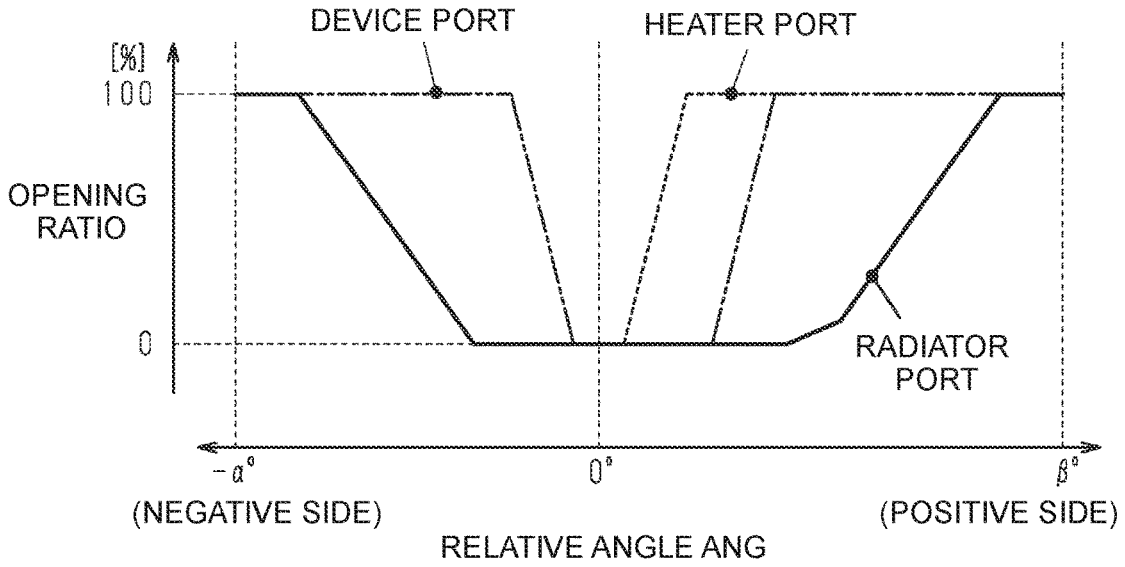
FIG. 6A is a graph showing a relationship between a relative angle of the valve body of the flow rate control valve and opening ratios of respective output ports.

FIG. 6A is a graph showing a relationship between the relative angle ANG of the valve body 35 relative to the housing 31 and opening ratios of the output ports P1 to P3. Incidentally, in the present embodiment, the relative angle ANG is used as a state quantity indicating an operating position of the valve body 35 in the flow rate control valve 26. Each of the opening ratios represents the ratio of the flow channel area of the corresponding one of the output ports on the assumption that the opening ratio is 100% when the output port is fully open.

In the flow rate control valve 26, the relative angle ANG is assumed to be "0°" when all the output ports P1 to P3 are closed, and the valve body 35 can be rotated relatively to the housing 31 in both the positive direction and the negative direction until the stopper 312 of the housing 31 and the engagement portion 354 of the valve body 35 abut on each other. The sizes and positions of the holes 351 and 352 of the valve body 35 are set such that the opening degrees of the output ports P1 to P3 change as shown in FIG. 6A as the relative angle ANG changes. In the present embodiment, when the valve body 35 is rotated relatively to the housing 31 in the positive direction, the relative angle ANG increases. On the other hand, when the valve body 35 is rotated relatively to the housing 31 in the negative direction, the relative angle ANG decreases.

In the flow rate control valve 26, when the valve body 35 is rotated relatively in the positive direction from the position where the relative angle ANG is "0°", the heater port P3 first starts opening, and the opening degree of the heater port P3 gradually increases as the relative angle ANG increases. Then, when the relative angle ANG further increases after the heater port P3 is fully opens, the device port P2 then opens. The opening degree of the device port P2 increases as the relative angle ANG increases. Then, after the device port P2 fully opens, the radiator port P1 starts opening. The opening degree of the radiator port P1 also increases as the relative angle ANG increases. In the case where the relative angle is "β°" when the engagement portion 354 and the stopper 312 abut on each other, the radiator port P1 fully opens before the valve body 35 reaches a position where the relative angle ANG is "+β°". Then, the output ports P1 to P3 are held fully open even when the relative angle ANG increases, until the valve body 35 reaches the position where the relative angle ANG is "β°".

On the other hand, in the flow rate control valve 26, when the valve body 35 is relatively rotated in the negative direction from the position where the relative angle ANG is "0°", the heater port P3 does not open. In this case, the device port P2 first starts opening, and the opening degree of the device port P2 gradually increases as the relative angle ANG decreases. Then, the relative angle ANG further decreases after the device port P2 fully opens, the radiator port P1 opens. The opening degree of the radiator port P1 increases as the relative angle ANG decreases. In the case where the relative angle is "−α°" when the engagement portion 354 and the stopper 312 abut on each other, the radiator port P1 fully opens before the valve body 35 reaches a position where the relative angle ANG is "−α°". Then, the radiator port P1 and the device port P2 are held fully open even when the relative angle ANG decreases, until the valve body 35 reaches the position where the relative angle ANG is "−α°".

Incidentally, in the engine cooling device configured as described above, coolant is circulated through the circulation circuit 21 by the mechanical water pump 22 that operates in response to rotation of the engine 10. In this engine cooling device, the discharge pressure of coolant in the water pump 22 rises as the engine rotational speed NE rises. On the other hand, in the foregoing engine cooling device, the flow of coolant through the circulation circuit 21 is changed by the flow rate control valve 26. In this engine cooling device, the hydraulic pressures at the respective portions of the circulation circuit 21 are determined by the engine rotational speed NE and the relative angle ANG of the valve body 35 of the flow rate control valve 26.

Incidentally, there is an upper limit of the permissible hydraulic pressure for each of component members of the circulation circuit 21. When the hydraulic pressure remains higher than the upper limit, the leakage of coolant may be caused. In the following description, the upper limit of the permissible hydraulic pressure for each of the component members of the circulation circuit 21 will be referred to as a withstanding pressure limit thereof. Besides, the maximum value of the engine rotational speed NE at which the hydraulic pressure in any region of the circulation circuit 21 is lower than the upper limit of the hydraulic pressure permissible in the region will be referred to as a withstanding pressure limit rotational speed.

In the present embodiment, in designing the engine cooling device, a value of the withstanding pressure limit rotational speed for each relative angle ANG of the valve body 35 of the flow rate control valve 26 is obtained through an experiment, a simulation, or the like. Moreover, a map M indicating the value of the withstanding pressure limit rotational speed for each relative angle ANG of the valve body 35 is stored in the memory 52 of the control unit 50. In the engine cooling device according to the present embodiment, the memory 52 corresponds to the storage unit in which information on the withstanding pressure limit rotational speed for each operating position of the valve body 35 is stored.

Figure 6B:
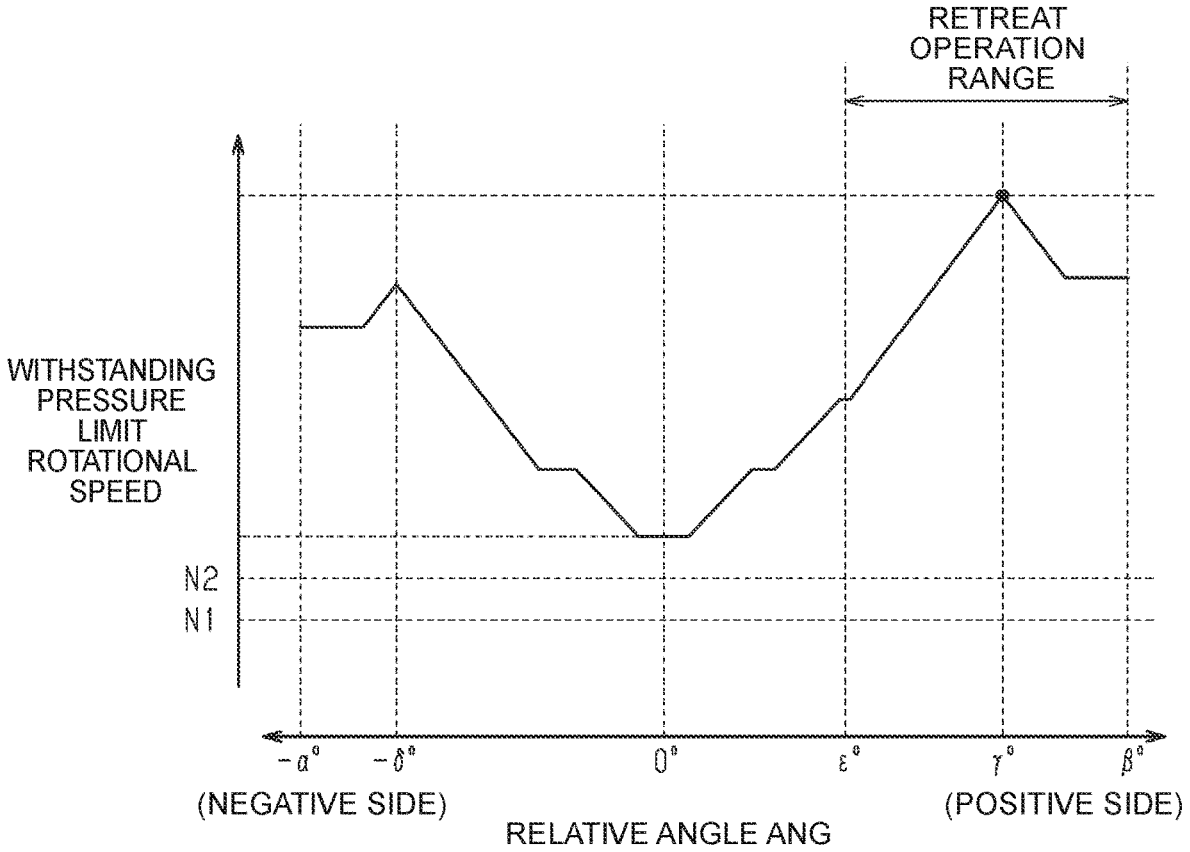
FIG. 6B is a graph showing a relationship between the relative angle of the valve body and a withstanding pressure limit rotational speed.

FIG. 6B shows a relationship between the relative angle ANG of the valve body 35 and the withstanding pressure limit rotational speed in the engine cooling device according to the present embodiment. When the valve body 35 is located at the position where the relative angle ANG is "0°", the opening ratios of the output ports P1 to P3 are all "0%", and the flow of coolant is blocked by the flow rate control valve 26. In the following description, that part of the circulation circuit 21 which is located downstream of the water pump 22 and upstream of the flow rate control valve 26 will be referred to as a pump/valve gap portion. When the engine rotational speed NE and hence the discharge pressure of the water pump 22 are raised with the flow of coolant blocked by the flow rate control valve 26, the hydraulic pressure at the pump/valve gap portion reaches the withstanding pressure limit. At this time, the withstanding pressure limit rotational speed is the engine rotational speed NE at which the hydraulic pressure at the pump/valve gap portion reaches the withstanding pressure limit.

When the valve body 35 is relatively rotated in the positive direction from the position where the relative angle ANG is "0°", the output ports P1 to P3 sequentially open, and coolant is delivered from the output ports P1 to P3. Then, as a result, the hydraulic pressure at the pump/valve gap portion is reduced. Therefore, when the valve body 35 is relatively rotated in the positive direction from the position where the relative angle ANG is "0°", the withstanding pressure limit rotational speed gradually rises.

On the other hand, when the flow rate of coolant delivered to the first coolant channel 271 from the radiator port P1 increases, the pressure loss of the coolant flowing through the radiator 23 increases, and the hydraulic pressure in that part of the circulation circuit 21 which is located upstream of the radiator 23 in the first coolant channel 271 rises. In the following description, that part of the circulation circuit 21 which is located upstream of the radiator 23 in the first coolant channel 271 will be referred to as a valve/radiator gap portion.

When the valve body 35 relatively rotates to the position where the relative angle ANG is "γ°", the engine rotational speed NE at which the hydraulic pressure at the pump/valve gap portion reaches the withstanding pressure limit becomes equal to the engine rotational speed NE at which the hydraulic pressure at the valve/radiator gap portion reaches the withstanding pressure limit. When the valve body 35 is relatively rotated further in the positive direction from the position where the relative angle ANG is "γ°", the engine rotational speed NE at which the hydraulic pressure at the pump/radiator gap portion reaches the withstanding pressure limit becomes lower than the engine rotational speed NE at which the hydraulic pressure at the pump/valve gap portion reaches the withstanding pressure limit. In consequence, in the range where the relative angle ANG is larger than "γ°", the withstanding pressure limit rotational speed is the engine rotational speed NE at which the hydraulic pressure at the valve/radiator gap portion reaches the withstanding pressure limit. Incidentally, when the valve body 35 is relatively rotated in the positive direction from the position where the relative angle ANG is "γ°", the flow rate of coolant in the first coolant channel 271 also increases as the opening ratio of the radiator port P1 increases. Therefore, the engine rotational speed NE at which the hydraulic pressure at the valve/radiator gap portion reaches the withstanding pressure limit drops. In consequence, the withstanding pressure limit rotational speed stops rising and starts dropping at the position where the relative angle ANG is "γ°" when the valve body 35 is relatively rotated in the positive direction from the position where the relative angle ANG is "0°".

By the same token, when the valve body 35 is relatively rotated in the negative direction from the position where the relative angle ANG is "0°" as well, the withstanding pressure limit rotational speed rises until the valve body 35 reaches the position where the relative angle ANG is "−δ°", and starts dropping afterward. In this manner, the withstanding pressure limit rotational speed is locally maximized at each of the relative rotational position of the valve body 35 where the relative angle ANG is "γ°", and the relative rotational position of the valve body 35 where the relative angle ANG is "−δ°". Incidentally, the three output ports P1 to P3 are all open at the relative rotational position of the valve body 35 where the relative angle ANG is "γ°". In contrast, among the three output ports P1 to P3, only the radiator port P1 and the device port P2 are open at the relative rotational position of the valve body 35 where the relative angle ANG is "−δ°". Therefore, within the range of relative rotation of the valve body 35 from the position where the relative angle ANG is "−α°" to the position where the relative angle ANG is "β°", the withstanding pressure limit rotational speed is maximized when the valve body 35 has relatively rotated to the position where the relative angle ANG is "γ°". In the following description, the relative rotational position of the valve body 35 where the relative angle ANG is "γ°" will be referred to as a maximum withstanding pressure relative rotational position.

Figure 7:
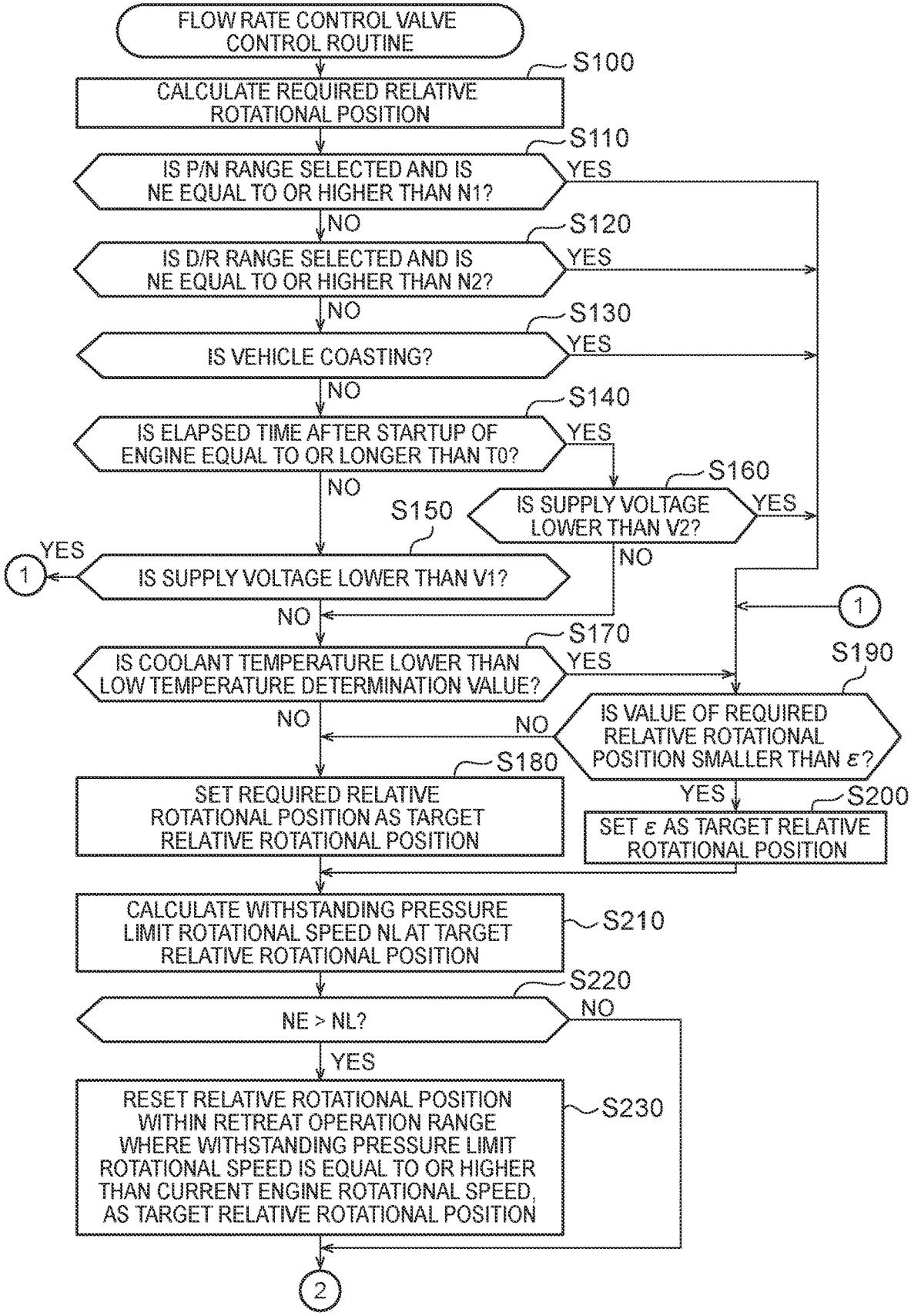
FIG. 7 is a flowchart showing part of a processing procedure of a flow rate control valve control routine that is carried out by a control unit provided in the engine cooling device according to the embodiment.
Figure 8:
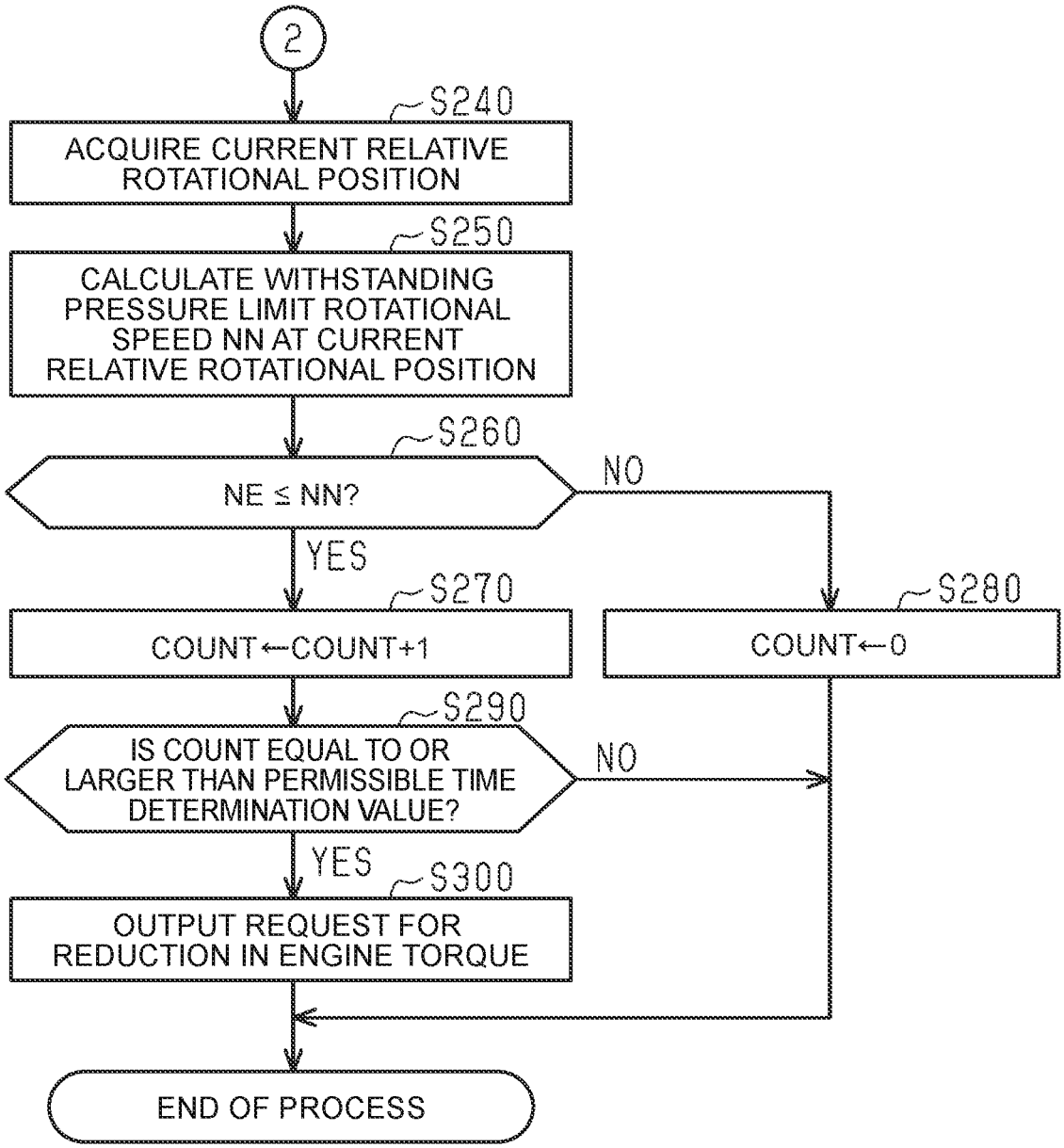
FIG. 8 is a flowchart showing the rest of the processing procedure of the flow rate control valve control routine.

Subsequently, the control of the flow rate control valve 26 of the engine cooling device according to the present embodiment will be described. FIGS. 7 and 8 are flowcharts of a flow rate control valve control routine that is carried out by the control unit 50 in controlling the flow rate control valve 26. The control unit 50 repeatedly performs the process of the routine on a prescribed control cycle during operation of the engine 10.

When the process of the present routine is started, a required relative rotational position is calculated first in step S100. In concrete terms, the relative angle ANG of the valve body 35 at which the opening ratios of the output ports P1 to P3 satisfy a requirement for the warming and cooling of the engine 10 and the ATF and a requirement for the warming of the cabin by the air-conditioner is calculated as a value of the required relative rotational position. Incidentally, the range of the relative rotational position of the valve body 35 that is set as the required relative rotational position ranges from the position where the relative angle ANG is "−α°" to the position where the relative angle ANG is "β°".

Subsequently, in steps S110 to S170, it is determined whether or not conditions (i) to (v) shown below are fulfilled. The condition (i) is that a shift range for parking (P) or a neutral shift range (N) is set as a shift range of the automatic transmission 241, and that the engine rotational speed NE is equal to or higher than a prescribed retreat start rotational speed N1 (YES in S110). Incidentally, as shown in FIG. 6B, the engine rotational speed NE that is lower than a minimum value of the withstanding pressure limit rotational speed is set as a value of the retreat start rotational speed N1.

The condition (ii) is that a shift range for running, namely, a shift range for forward running (D) or a shift range for backward running (R) is set as the shift range of the automatic transmission 241, and that the engine rotational speed NE is equal to or higher than a prescribed retreat start rotational speed N2 (YES in S120) Incidentally, the engine rotational speed NE that is higher than the retreat start rotational speed N1 in the condition (i) is set as a value of the retreat start rotational speed N2 in the condition (ii).

The condition (iii) is that the vehicle is coasting (YES in S130). In the present embodiment, it is determined that the vehicle is coasting when the operation amount of the accelerator pedal has remained equal to "ε°" and the engine rotational speed NE has remained equal to or higher than a certain rotational speed for a prescribed time or more.

The condition (iv) is that the post-startup elapsed time as an elapsed time after the beginning of the startup of the engine 10 is shorter than a prescribed time T0 (NO in S140), and that the supply voltage of the in-vehicle electric power supply 53 is lower than a voltage drop determination value V1 (YES in S150).

The condition (v) is that the post-startup elapsed time is equal to or longer than the prescribed time T0 (YES in S140), and that the supply voltage of the in-vehicle electric power supply 53 is equal to or lower than a voltage drop determination value V2 (YES in S160). Incidentally, a voltage higher than the voltage drop determination value V1 is set as the voltage drop determination value V2.

The condition (vi) is that the temperature of coolant is lower than a prescribed low-temperature determination value (YES in S170). When none of the conditions (i) to (vi) is fulfilled, the value of the required relative rotational position is directly set as the value of the target relative rotational position in step S180, and the process is then advanced to step S210. As described above, the relative rotational position of the valve body 35 that is set as the required relative rotational position ranges from the position where the relative angle ANG is "−α°" to the position where the relative angle ANG is "β°". Therefore, the relative rotational position of the valve body 35 that is set as the target relative rotational position at this time also ranges from the position where the relative angle ANG is "−α°" to the position where the relative angle ANG is "β°".

In contrast, in the case where at least one of the conditions (i) to (vi) is fulfilled as well, when the value of the required relative rotational position is equal to or larger than "ε°" (NO in S190), the value of the required relative rotational position is directly set as the value of the target relative rotational position in step S180, and the process is then advanced to step S210. On the other hand, when at least one of the conditions (i) to (vi) is fulfilled and the value of the required relative rotational position is smaller than "ε°" (YES in S190), "ε°" is set as the value of the target relative rotational position in step S200, and the process is then advanced to step S210. When at least one of the conditions (i) to (vi) is fulfilled in this manner, the relative rotational position of the valve body 35 that is set as the target relative rotational position ranges from the position where the relative angle ANG is "ε°" to the position where the relative angle ANG is "β°".

The value of the relative rotational position that is located on the positive side from the position where the relative angle ANG is "ε°" is set as the value of the target relative rotational position in the case where at one of the conditions (i) to (vi) is fulfilled in this manner. As shown in FIG. 6B, "ε°" is the relative angle ANG at an end on the negative side of a retreat operation range set in advance as the range of relative rotation of the valve body 35, including the relative rotational position of the valve body 35 where the relative angle ANG as the maximum withstanding pressure relative rotational position is "γ°". Accordingly, when at least one of the conditions (i) to (vi) is fulfilled, the relative angle ANG within the retreat operation range is set as the value of the target relative rotational position.

It should be noted herein that the control range of the valve body 35 is defined as the range of the relative rotational position of the valve body 35 that is set as the target relative rotational position. The control range of the valve body 35 in the case where none of the conditions (i) to (vi) is fulfilled is the range from the position where the relative angle ANG is "−α°" to the position where the relative angle ANG is "β°". In contrast, when at least one of the conditions (i) to (vi) is fulfilled, the control range is reduced to the retreat operation range set in advance as the range of the relative rotational position of the valve body 35 including the maximum withstanding pressure relative rotational position.

When the process is advanced to step S210 subsequently to the setting of the target relative rotational position in step S180 or step S200 as described above, a value of a withstanding pressure limit rotational speed NL at the relative angle ANG set as the value of the target relative rotational position is calculated, based on the map M stored in the memory 52, in step S210. Furthermore, subsequently in step S220, it is determined whether or not the calculated withstanding pressure limit rotational speed NL is lower than the current engine rotational speed NE. Then, if the withstanding pressure limit rotational speed NL at the target relative rotational position is equal to or higher than the current engine rotational speed NE (NO), the process is directly advanced to step S240. In contrast, if the withstanding pressure limit rotational speed NL at the target relative rotational position is lower than the current engine rotational speed NE (YES), the withstanding pressure limit rotational speed is equal to or higher than the current engine rotational speed NE in step S230, and the relative angle ANG within the retreat operation range is obtained based on the map M. Then, after the obtained relative angle ANG is further reset as the value of the target relative rotational position in step S230, the process is advanced to step S240.

When the process is advanced to step S240, a value of the relative angle ANG at the relative rotational position where the valve body 35 is currently located is acquired in step S240. Incidentally, in the following description, the relative angle ANG at the relative rotational position where the valve body 35 is currently located will be referred to as a current relative angle. Incidentally, the current relative angle is obtained from a result of detection of the rotational angle of the motor 37 by the rotational angle sensor 123.

Subsequently in step S250, a withstanding pressure limit rotational speed NN at the current relative angle is calculated based on the map M stored in the memory 52. Then, subsequently in step S260, it is determined whether or not the current engine rotational speed NE is higher than the withstanding pressure limit rotational speed NN at the calculated current relative angle. If the withstanding pressure limit rotational speed NN is higher than the current engine rotational speed NE (YES), an operation of incrementing the value of a counter COUNT is performed in step S270, and the process is then advanced to step S290. On the other hand, if the withstanding pressure limit rotational speed NN is equal to or lower than the current engine rotational speed NE (NO in S260), an operation of clearing the value of the counter COUNT to "0" is performed in step S280, and the process of the present routine is then ended. The value of the counter COUNT thus operated represents a time during which the withstanding pressure limit rotational speed NN has remained higher than the current engine rotational speed NE.

When the process is advanced to step S290, it is determined in step S290 whether or not the value of the counter COUNT is equal to or larger than a prescribed permissible time determination value. If the value of the counter COUNT at this time is smaller than the permissible time determination value (NO), the process of the present routine on the current cycle is ended immediately. On the other hand, if the value of the counter COUNT at this time is equal to or larger than the permissible time determination value (YES), a request for a reduction in engine torque is output to the engine control unit 55, and the process of the present routine on the current cycle is then ended. Incidentally, the engine control unit 55 reduces the torque of the engine 10 in accordance with the inputting of the request for the reduction in engine torque.

Incidentally, the control unit 50 performs supply control of the motor 13 to relatively rotate the valve body 35 toward the target relative rotational position set in the present routine. That is, when the current relative rotational position of the valve body 35 is located in the negative direction from the target rotational position, the control unit 50 supplies electric power to the motor 37 such that the rotational direction of the motor 37 coincides with the direction in which the valve body 35 is relatively rotated in the positive direction. Besides, when the current relative rotational position of the valve body 35 is located in the positive direction from the target rotational position, the control unit 50 supplies electric power to the motor 37 such that the rotational direction of the motor 37 coincides with the direction in which the valve body 35 is relatively rotated in the negative direction. Then, when the current relative rotational position of the valve body 35 coincides with the target relative rotational position, the control unit 50 stops supplying electric power to the motor 37.

The operation and effect of the present embodiment will be described. In the engine cooling device according to the present embodiment that is equipped with the mechanical water pump 22 as described above, the value of the required relative rotational position is set in accordance with the requirement for the warming and cooling of the engine 10 and ATF and the requirement for the warming by the air-conditioner, and the value of the required relative rotational position is usually set directly as the value of the target relative rotational position. Then, supply control of the motor 37 is performed to change the relative rotational position of the valve body 35 to the set target relative rotational position.

On the other hand, in the engine cooling device according to the present embodiment that adopts the mechanical water pump 22 operating in response to rotation of the engine 10, the discharge pressure of coolant in the water pump 22 rises as the engine rotational speed NE rises. Moreover, the hydraulic pressure of the circulation circuit 21 may become higher than the withstanding pressure limit when the valve body 35 of the flow rate control valve 26 is located at a certain relative rotational position at that time.

In contrast, the engine cooling device according to the present embodiment performs protection control for restraining the hydraulic pressure of the circulation circuit 21 from rising above the withstanding pressure limit by resetting the relative rotational position where the withstanding pressure limit rotational speed is equal to or higher than the current engine rotational speed NE, as the value of the target relative rotational position, when the engine rotational speed NE rises.

Besides, in the present embodiment, when at least one of the conditions (i) to (vi) is fulfilled, retreat control for resetting the relative rotational position within the retreat operation range set in advance as the range of the relative rotational position of the valve body 35 including the maximum withstanding pressure relative angle, as the target relative rotational position is performed. Thus, the relative rotational position of the valve body 35 is changed to the relative rotational position within the retreat operation range, namely, to the range that is not greatly distant from the maximum withstanding pressure relative rotational position.

Incidentally, even in the case where retreat control and protection control as described above are performed, when the engine rotational speed NE remains higher than the withstanding pressure limit rotational speed, a request for a reduction in engine torque is output to the engine control unit 55, and the engine rotational speed NE is restrained from rising due to the reduction in engine torque corresponding to the request.

The engine cooling device according to the present embodiment described above can exert the following effects.

(1) In the present embodiment, the foregoing retreat control is performed when the supply voltage of the in-vehicle electric power supply 53 has dropped. When the supply voltage of the in-vehicle electric power supply 53 drops, the speed at which the relative rotational position of the valve body 35 is changed by the motor 37 drops, and the time needed to change the relative rotational position of the valve body 35 in protection control becomes long. In this respect, when the foregoing retreat control is performed prior to the performance of protection control, the amount of change in the relative rotational position of the valve body 35 in the case where protection control is thereafter performed in response to a rise in the engine rotational speed NE does not increase beyond a certain amount. Therefore, even when the supply voltage of the in-vehicle electric power supply 53 drops to cause a drop in the speed at which the relative rotational position of the valve body 35 is changed, the time needed to change the relative rotational position of the valve body 35 in protection control is unlikely to become long. Accordingly, even in the case where the supply voltage of the in-vehicle electric power supply 53 has dropped, the time needed to restrain the hydraulic pressure of the circulation circuit 21 from rising when the engine rotational speed NE rises is unlikely to become long.

(2) Information on the withstanding pressure limit rotational speed at each relative rotational position of the valve body 35 is stored in advance in the memory 52. In protection control, the relative rotational position of the valve body 35 at which the withstanding pressure limit rotational speed obtained based on the information is higher than the current engine rotational speed NE is set as the target relative rotational position. Therefore, in protection control, the appropriate target relative rotational position at which the withstanding pressure limit rotational speed is equal to or higher than the engine rotational speed NE can be set.

(3) It is determined whether or not the engine torque needs to be reduced, by determining that the engine torque needs to be reduced when the current engine rotational speed NE has remained higher than the withstanding pressure limit rotational speed at the current relative rotational position of the valve body 35 for the prescribed time or more. Therefore, the hydraulic pressure can be restrained from rising, by making a request for a reduction in engine torque and retraining the engine rotational speed NE from rising when the hydraulic pressure cannot be sufficiently restrained from rising through protection control.

(4) Immediately after the startup of the engine, the supply voltage of the in-vehicle electric power supply 53 may temporarily drop due to the consumption of electric power for the startup of the engine. This drop in supply voltage of the in-vehicle electric power supply 53 immediately after the startup of the engine is stopped in a short time, so the performance of retreat control as a measure against the drop in supply voltage on this occasion is often unnecessary. In contrast, according to the present embodiment, when the elapsed time after the startup of the engine is shorter than the prescribed time T0, the voltage higher than in the case where the elapsed time is equal to or longer than the prescribed time T0 is set as the voltage drop determination value, so retreat control is unlikely to be performed unnecessarily.

(5) When the coolant temperature is low, the viscosity of coolant is high, and the flow resistance of coolant applied to the valve body 35 in changing the relative rotational position of the valve body 35 is high. Therefore, even when the temperature of coolant is low, the speed at which the relative rotational position of the valve body 35 is changed by the motor 37 is low. In contrast, according to the present embodiment, retreat control is performed even when the coolant temperature is equal to or lower than the prescribed low coolant temperature determination value. Therefore, even in the case where the speed at which the relative rotational position of the valve body 35 is changed by the motor 37 has dropped due to the low coolant temperature, the hydraulic pressure of the circulation circuit 21 is unlikely to be insufficiently restrained from rising when the engine rotational speed NE rises.

(6) Retreat control is performed even when the engine rotational speed NE is high to a certain extent and the performance of protection control may be needed in a short time. Therefore, the hydraulic pressure of the circulation circuit 21 can be swiftly restrained from rising when the engine rotational speed NE rises.

(7) In setting the shift range for stop or the shift range for neutrality, the transmission of motive power between the engine 10 and the wheels is shut off by the automatic transmission 241, and that part of a motive power transmission system of the vehicle which is located on the wheel sides from the automatic transmission 241 is disconnected from the engine 10, so the rotational load of the engine 10 decreases. Therefore, in setting the shift range for stop or the shift range for neutrality, the speed at which the engine rotational speed NE rises tends to be higher than in setting the shift range for running with the transmission of motive power not shut off. In contrast, according to the present embodiment, when the shift range of the automatic transmission 241 is set as the shift range for stop or the shift range for neutrality, retreat control is performed at the engine rotational speed NE that is lower than when the shift range of the automatic transmission 241 is set as the shift range for running. Therefore, even in the case where the transmission of motive power between the engine 10 and the wheels is shut off by the automatic transmission 241 and the speed at which the engine rotational speed NE rises tends to be high, the hydraulic pressure of the circulation circuit is easily restrained from rising when the engine rotational speed NE rises.

(8) In the engine 10 mounted on the vehicle, while the vehicle is coasting with the engine 10 dragged as the wheels rotate, the engine rotational speed may rapidly rise through a downshift or the like. In contrast, according to the present embodiment, retreat control is performed even while the vehicle is coasting. Therefore, the hydraulic pressure of the circulation circuit 21 is easily restrained from rising even when the engine rotational speed NE rapidly rises while the vehicle is coasting.

Incidentally, according to the present embodiment, the operating position of the valve body 35 in the flow rate control valve 26 is represented by the rotational position of the valve body 35 relative to the housing 31. In the present embodiment, the target relative rotational position corresponds to the target operating position, and the maximum withstanding pressure relative rotational position corresponds to the maximum withstanding pressure operating position.

The present embodiment can be carried out after being modified as follows. The present embodiment and the following modification examples can be carried out in combination with one another within such a range that no technical contradiction occurs. In the foregoing embodiment, the information on the withstanding pressure limit rotational speed at each relative rotational position of the valve body 35 is stored in a recording device 42 as the map M, and the target relative rotational position in protection control is calculated based on the stored information. However, the target relative rotational position in protection control may be calculated according to another method, without storing the aforementioned information. For example, the target relative rotational position in protection control may be fixed to the maximum withstanding pressure operating position or the like.

In the foregoing embodiment, when the current engine rotational speed NE has remained higher than the withstanding pressure limit rotational speed at the current relative rotational position of the valve body 35 for the prescribed time or more, it is determined that the engine torque needs to be reduced, and a request for a reduction in engine torque is output to the engine control unit 55. The determination on the necessity to reduce the engine torque and the outputting of the request for reduction may be omitted.

In the foregoing embodiment, when the shift range of the automatic transmission 241 is set as the shift range for stop or the shift range for neutrality to shut off the transmission of motive power between the engine 10 and the wheels, retreat control is performed from the engine rotational speed NE that is lower than in setting the shift range for running with the transmission of motive power not shut off. In a vehicle adopting a manual transmission, the transmission of motive power between an engine and wheels is shut off when a clutch provided between the engine and the manual transmission is disengaged or when the manual transmission is in a neutral state. In consequence, in the vehicle adopting the manual transmission, when at least one of a condition (vii) that the clutch is disengaged and a condition (viii) that the manual transmission is in the neutral state is fulfilled, retreat control may be performed from the engine rotational speed NE that is lower than when both the conditions (vii) and (viii) are not fulfilled.

In the foregoing embodiment, when the transmission of motive power between the engine and the wheels is shut off, retreat control is performed from the engine rotational speed NE that is lower than when the transmission of motive power between the engine and the wheels is not shut off. However, retreat control may be performed when the engine rotational speed NE becomes equal to or higher than a certain rotational speed, regardless of whether or not the transmission of motive power is shut off.

In the foregoing embodiment, the low-voltage determination value is changed depending on the elapsed time after the startup of the engine. However, a fixed value may be set as the low-voltage determination value, regardless of the elapsed time after the startup of the engine.

Retreat control is performed when at least one of the conditions (i) to (vi) is fulfilled. However, one or more of the conditions (i), (ii), (iii), and (vi) may be omitted.

The number of output ports of the flow rate control valve 26 and the number of coolant channels leading to the output ports in the circulation circuit may be appropriately changed. The flow rate control valve 26 adopted in the foregoing embodiment has the valve body 35 that rotates relatively to the housing 31, and the flow channel area of coolant at the output ports changes depending on the relative rotational position of the valve body 35. However, a flow rate control valve having a valve body that performs an operation other than relative rotation, such as a reciprocating rectilinear motion may be adopted.

A flow rate control valve adopting an electric actuator other than the motor 37, for example, an electromagnetic solenoid, as an actuator for driving the valve body 35 may be adopted.

What is claimed is:

1. An engine cooling device comprising:

a circulation circuit for coolant flowing through a water jacket formed inside an engine;

a mechanical water pump that operates in response to rotation of the engine and that circulates the coolant through the circulation circuit;

a flow rate control valve that serves to adjust a flow rate of the coolant flowing through the circulation circuit, that has a valve body driven by an electric actuator operating by being supplied with electric power from an in-vehicle electric power supply, and that allows a flow channel area for the coolant to change depending on an operating position of the valve body; and a control unit that sets an operating position within a prescribed control range as a target operating position in accordance with an operating situation of the engine, and that performs drive control of the actuator to change the operating position of the valve body to the set target operating position, wherein the control unit performs protection control for setting an operating position where a withstanding pressure limit rotational speed is equal to or higher than a current engine rotational speed, as the target operating position, and performs retreat control for reducing the control range to a retreat operation range set in advance, as a range of the operating position including a maximum withstanding pressure operating position, when a supply voltage of the in-vehicle electric power supply has dropped, in a case where the withstanding pressure limit rotational speed is defined as a maximum value of the engine rotational speed at which a hydraulic pressure in any region of the circulation circuit is lower than an upper limit of the hydraulic pressure permissible in the region, and where the maximum withstanding pressure operating position is defined as an operating position where the withstanding pressure limit rotational speed is highest among operating positions within the control range.

2. The engine cooling device according to claim 1, further comprising:

a storage unit in which information on the withstanding pressure limit rotational speed at each operating position of the valve body is stored, wherein the control unit obtains an operating position of the valve body where the withstanding pressure limit rotational speed is higher than the current engine rotational speed, based on the information stored in the storage unit, and performs the protection control by setting the obtained operating position as the target operating position.

3. The engine cooling device according to claim 1, wherein the control unit determines whether or not an engine torque needs to be reduced, by determining that the engine torque needs to be reduced when the current engine rotational speed has remained higher than the withstanding pressure limit rotational speed at a current operating position of the valve body for a prescribed time or more.

4. The engine cooling device according to claim 1, wherein the control unit determines that a supply voltage of the in-vehicle electric power supply has dropped when the supply voltage is equal to or lower than a voltage drop determination value, and sets a higher voltage as the voltage drop determination value when an elapsed time after startup of the engine is shorter than a prescribed time than when the elapsed time is equal to or longer than the prescribed time.

5. The engine cooling device according to claim 1, wherein the control unit also performs the retreat control when a temperature of the coolant is equal to or lower than a prescribed low coolant temperature determination value.

6. The engine cooling device according to claim 1, wherein the control unit also performs the retreat control when the engine rotational speed is equal to or higher than a prescribed retreat start rotational speed.

7. The engine cooling device according to claim 6, wherein the engine cooling device being applied to an engine mounted on a vehicle, and the control unit sets a lower rotational speed as the retreat start rotational speed when transmission of motive power between the engine and wheels is shut off than when transmission of motive power between the engine and the wheels is not shut off.

8. The engine cooling device according to claim 1, wherein the engine cooling device being applied to an engine mounted on a vehicle, and the control unit also performs the retreat control while the vehicle is coasting.

* * * * *